US007371686B2

(12) United States Patent
Arai

(10) Patent No.: US 7,371,686 B2
(45) Date of Patent: May 13, 2008

(54) METHOD AND APPARATUS FOR POLISHING A SEMICONDUCTOR DEVICE

(75) Inventor: Kentarou Arai, Minato-ku (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 34 days.

(21) Appl. No.: 11/151,395

(22) Filed: Jun. 14, 2005

(65) Prior Publication Data

US 2006/0040586 A1 Feb. 23, 2006

(30) Foreign Application Priority Data

Aug. 17, 2004 (JP) ..... 2004-236976

(51) Int. Cl.
*H01L 21/302* (2006.01)
*B44C 1/22* (2006.01)

(52) U.S. Cl. ..... 438/691; 438/692; 216/84; 216/85; 216/86; 216/89

(58) Field of Classification Search ..... 438/691, 438/692; 216/84, 89, 85, 86
See application file for complete search history.

(56) References Cited

U.S. PATENT DOCUMENTS 6,594,542 B1 * 7/2003 Williams ..... 700/164
2005/0260922 A1 * 11/2005 Gan et al. ..... 451/5

FOREIGN PATENT DOCUMENTS

JP 09-155722 A 6/1997

* cited by examiner

*Primary Examiner*—Binh X. Tran
(74) *Attorney, Agent, or Firm*—Volentine & Whitt, P.L.L.C.

(57) ABSTRACT

A method and an apparatus for polishing a semiconductor wafer are provided. An initial thickness of the semiconductor wafer is actually measured to obtain a measured initial thickness value. First and second inter-positions are then set or determined with reference to the measured initial thickness value. The first and second inter-positions are predetermined taking into account any variation in the initial thickness of the semiconductor wafer. A polishing process is carried out under control to a motion of a polishing pad toward a stage, on which the semiconductor pad is held.

5 Claims, 7 Drawing Sheets

METHOD AND APPARATUS FOR POLISHING A SEMICONDUCTOR DEVICE

BACKGROUND OF THE INVENTION

1. Field of the Invention

The present invention generally relates to a method and an apparatus for polishing a semiconductor wafer. More specifically, the present invention relates to a method and an apparatus for polishing a wafer level semiconductor device such as a wafer level chip size package, which will hereinafter referred to as W-CSP.

2. Background Information

All patents, patent applications, patent publications, scientific articles, and the like, which will hereinafter be cited or identified in the present application, will, hereby be incorporated by reference in their entirety in order to describe more fully the state of the art to which the present invention pertains.

In a series of manufacturing processes for a semiconductor device, a back-side polishing so called "back-grind" may be performed to polish a back-surface of a semiconductor wafer prior to dicing the wafer. This back-surface of the wafer is opposite a front-surface that has an integrated circuit that includes the semiconductor device.

In the manufacturing processes, an encapsulation process may be performed for encapsulating the wafer level semiconductor device with an encapsulation resin to form an encapsulated semiconductor package that is incomplete as a product. This incomplete package is then polished to have a required thickness and produce the W-CSP as the product.

The polishing process is also performed using a moveable polishing pad that polishes the semiconductor wafer surface. The polishing pad descends and contacts with the wafer surface for polishing the same. The polishing pad descends or moves closer to the wafer under a descending-speed control.

Japanese Laid-Open Patent Publication No. 9-155722 discloses a conventional process for polishing the semiconductor wafer and a conventional chemical mechanical polishing (CMP) apparatus therefor. The conventional apparatus includes a polishing cloth made of a highly rigid material, a suction table positioned over the polishing cloth, and a sensor positioned over the suction table. The suction table has a downward face that holds the semiconductor wafer thereon. The suction table is also movable up and down. The suction table presses the wafer to the polishing cloth for polishing the wafer with the polishing cloth. As the polishing process progresses, the suction table descends slowly and slightly. The sensor detects a displacement of the suction table. Further, such a highly rigid polishing cloth prevents the wafer from downwardly sinking into the polishing cloth. Both the high rigidity of the polishing cloth and the detection of the displacement allow for highly accurate control of the polishing amount.

Further description will be made of another conventional descending-speed control method involved in the polishing process. A polishing pad descends, at a higher descending-speed, from a stand-by position to a predetermined interposition A' between the stand-by positioned and the wafer surface. At the interposition A', a reduction in the higher descending-speed commences and continues until the pad has a predetermined lower descending-speed, which is the speed at which the polishing pad contacts the polishing surface of the wafer. The above reduction of the descending-speed relaxes impact force of a collision between the polishing pad and the wafer, thereby avoiding or reducing possible impact damage to the wafer. When the polishing pad has just polished the wafer by a predetermined thickness or amount that is less than a finally required polishing-amount, the polishing pad is positioned at a polishing-halfway-position B' where a change or increase in the descending-speed from the lower descending-speed is commenced to allow the polishing pad to perform further the remaining polishing process at the increased descending-speed.

In accordance with the conventional method, the above interposition A', at which the above speed reduction is commenced, can be determined by taking into account unavoidable variation in the actual thickness of the unpolished wafer. The interposition A' is set based on a sum of a given initial thickness value T1' and a first compensation value $\alpha'$, so that a relation $A'=T1'+\alpha'$ is established, where T1' and $\alpha'$ are constant, respectively. Thus, the above interposition A' is also fixed and given commonly to various actual thicknesses of the unpolished wafers. The fixed interposition A' and the unavoidable variation of the actual wafer thickness cause undesired variation in a first actual distance that is defined between the unpolished wafer surface and the fixed interposition A'.

If the actual thickness of the unpolished wafer is greater than the given initial thickness value T1', then the first actual distance is shorter than a first necessary distance for avoiding or reducing possible impact damage to the wafer. This causes the polishing pad to reach the polishing wafer surface at an insufficiently reduced speed that is still higher than the above-described desired lower descending-speed, resulting in possible impact damage to the wafer. If the actual thickness of the unpolished wafer is smaller than the given initial thickness value T1', then the actual distance is longer than the above-described necessary distance. This may avoid any possible impact damage to the wafer, but causes unnecessary time consumption during descent or moving down of the pad at the lower descending-speed before the polishing pad reaches the polishing wafer surface. In this point of view, it is desired that the actual thickness of the unpolished wafer is smaller than the given initial thickness value T1'.

The polishing-halfway-position B', at which the above speed increase is commenced, is set based on a sum of a finally required target thickness value T2' and a second compensation value $\beta'$, so that another relation $B'=T2'+\beta'$ is established, where T2' and $\beta'$ are constant, respectively. Thus, the above polishing-halfway-position B' is also fixed and commonly given to various actual thicknesses of the unpolished wafers. The fixed polishing-halfway-position B' and the unavoidable variation of the actual wafer thickness cause undesired variation in a second actual distance that is defined between the unpolished wafer surface and the fixed polishing-halfway-position B'.

If the actual thickness of the unpolished wafer is greater than the given initial thickness value T1', then the polishing pad polishes the wafer at the lower descending-speed by a sufficient thickness to avoid or to reduce any impact damage to the wafer before the polishing pad reaches the polishing-halfway-position B', and the descending-speed is increased. If the actual thickness of the unpolished wafer is smaller than the given initial thickness value T1', then the polishing pad polishes the wafer at the lower descending-speed by a smaller thickness than the above sufficient thickness before the polishing pad reaches the polishing-halfway-position B', and the descending-speed is increased. To avoid or to reduce any impact damage to the wafer, it is desired that the polishing pad polishes the wafer at the lower descending-speed until cutting blades of the polishing pad are well-engaged into the wafer surface and the polishing process is stabilized. In this point of view, it is desired that the actual thickness of the unpolished wafer is greater than the given initial thickness value T1'.

Consequently, any substantive variations in the actual thickness of the unpolished wafer from the given initial thickness value T1' causes either one of the above two disadvantages.

In accordance with the CMP apparatus disclosed in the above-described Japanese publication, the sensor detects the displacement of the suction table in order to monitor the polishing amount and then control the polishing process based on the monitored polishing amount. It should be noted that the CMP apparatus does not control the descending-speed of the suction table.

In the above-described circumstances, it had been desired to establish or to develop a certain polishing technique free from the above disadvantages caused by the unavoidable variation in the actual thickness of the wafer.

In view of the above, it will be apparent to those skilled in the art from this disclosure that there exists a need for an improved a method and an apparatus for polishing a semiconductor device. This invention addresses this need in the art as well as other needs, which will become apparent to those skilled in the art from this disclosure.

SUMMARY OF THE INVENTION

In accordance with a first aspect of the present invention, a method of polishing a semiconductor wafer on a first stage surface of a polishing stage is provided with a polishing pad. The method includes the steps of: measuring an initial thickness of the semiconductor wafer to obtain a measured initial thickness value; setting a first speed-changing position between a stand-by position of the polishing pad and the first stage surface, the first speed-changing position being distanced from the first stage surface by a first sum of the measured initial thickness value and a first correction value; setting a second speed-changing position between the stand-by position and the first stage surface, the second speed-changing position being distanced from the first stage surface by a first remainder obtained by subtracting a second correction value from the measured initial thickness value; causing the polishing pad to move, at a first moving-speed, from the stand-by position to the first speed-changing position; changing the first moving-speed to a second moving-speed lower than the first moving-speed when the polishing pad reaches the first speed-changing position, to cause the polishing pad to contact with a first wafer surface of the semiconductor wafer at the second moving-speed; and causing the polishing pad to polish the first wafer surface while maintaining the second moving-speed until the polishing pad reaches the second speed-changing position.

In accordance with the present invention, the initial thickness of the semiconductor wafer is measured to obtain a measured initial thickness value. The first and second inter-positions are then set or determined with reference to the measured initial thickness value. The first and second inter-positions are predetermined, prior to the polishing process, taking into account any variation in the initial thickness of the semiconductor wafer. This ensures that possible impact damage to the semiconductor wafer is reduced or avoided. This also allows optimizations of the first and second inter-positions to shorten a time until the polishing pad reaches the polishing surface of the semiconductor wafer, while reducing or avoiding impact damage to the semiconductor wafer upon collision between them.

Other objects and further features of the present invention will be apparent from the following descriptions accompanying drawings and from the detailed description which follows.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

First Embodiment (Polishing Apparatus)

Figure 1:
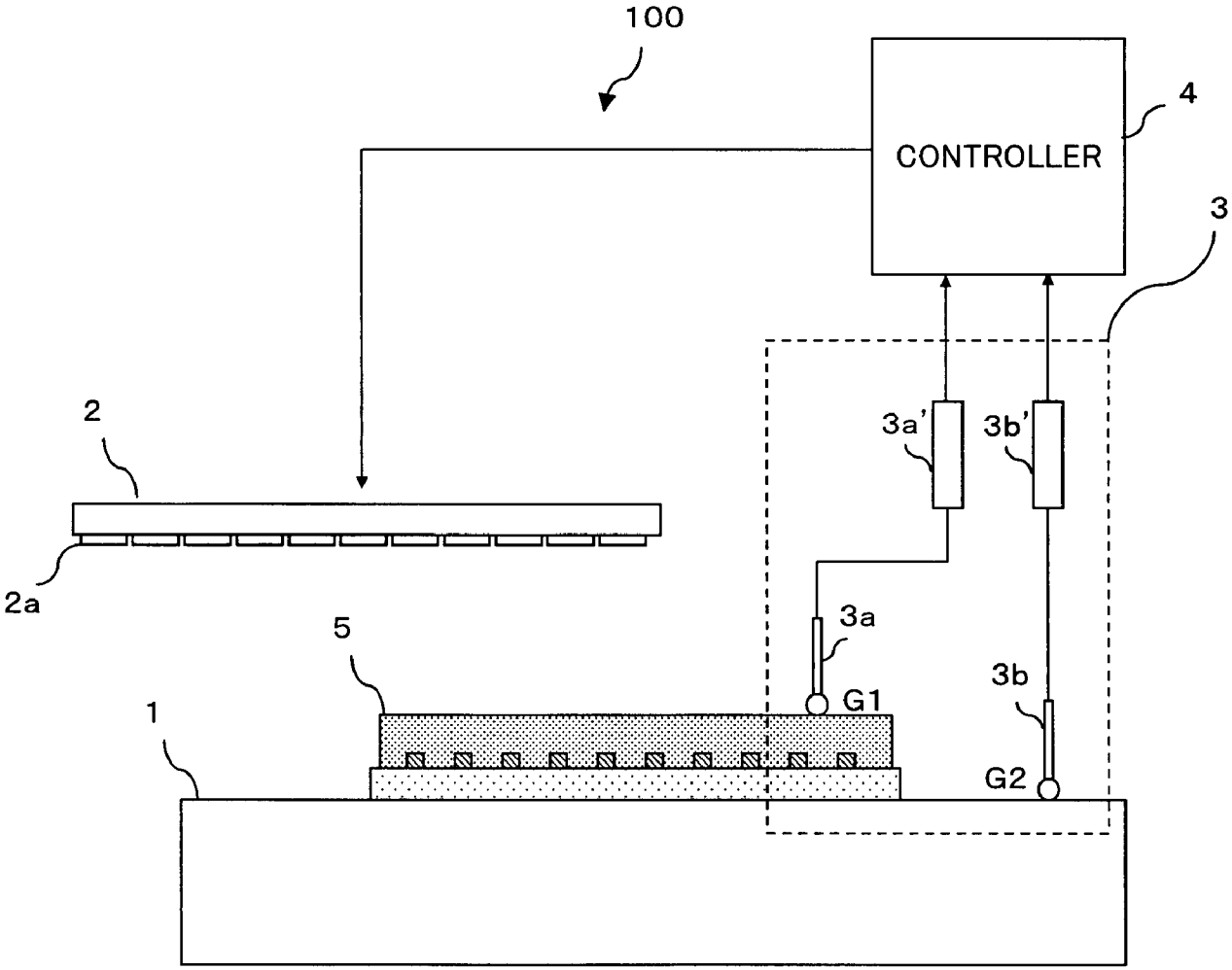
FIG. 1 is a schematic view illustrating a polishing apparatus in accordance with the first preferred embodiment of the present invention.

FIG. 1 illustrates a polishing apparatus in accordance with the first embodiment of the present invention. A polishing apparatus 100 includes a polishing stage 1, a polishing pad 2, a detector unit 3, and a control unit 4. The polishing stage 1 has a first stage surface to hold a semiconductor wafer 5 thereon. The polishing pad 2 polishes the semiconductor wafer 5. The detector unit 3 detects a first displacement G1 in the level of a polishing surface or upper surface of the semiconductor wafer 5 and a second displacement G2 in the level of the first stage surface of the polishing stage 1. The control unit 4 controls a vertical motion of the polishing pad 2 in a vertical direction to the first stage surface. The polishing stage 1 is configured to hold the semiconductor device 5 on the first stage surface preferably by suction force.

The term "semiconductor wafer" means any one of a variety of semiconductor wafers, which include wafer-level semiconductor devices such as a wafer-level chip size package, and a semiconductor wafer free of any device. For example, the semiconductor wafer may include a wafer-level chip size package that has a polishing surface having an encapsulation resin such as an epoxy resin. Alternatively, the semiconductor wafer may also have an elemental semiconductor substrate such as a silicon substrate or a compound semiconductor substrate such as a gallium arsenide substrate. In the later case, the polishing process has a back-grind. It should be noted that FIG. 1 illustrates the wafer-level chip size package that has a light-gray rectangular region on the polishing stage 1 and a dark-gray rectangular region overlying the light-gray rectangular region. This wafer-level chip size package will thus be referred to as "semiconductor wafer".

The polishing stage 1 also has a bottom center that is mechanically connected with a first rotational axis of a first motor. The first rotational axis and the first motor are not illustrated but have respectively known structures. The polishing stage 1 rotates around the first rotational axis in a first rotational direction by rotation of the first motor. The polishing pad 2 has a top center that is mechanically connected with a second rotational axis of a second motor. The second rotational axis and the second motor are not illustrated but have respectively known structures. The polishing pad 2 rotates around the second rotational axis in a second rotational direction opposite to the first rotational direction by rotation of the second motor. The polishing pad 2 has a polishing face that has a plurality of cutting blades 2*a*. The polishing pad 2 has a second center axis that is always kept to be off-set horizontally from a first center axis of the polishing stage 1 by a predetermined horizontal distance. During a polishing process, the polishing pad 2 is arranged to be horizontally off-set from the polishing stage 1.

The detector unit 3 further includes a first level-sensor 3*a*, a second level-sensor 3*b*, and first and second level-detectors 3*a*' and 3*b*'. The first level-sensor 3*a* is adapted to measure a variable level of the polishing surface of the wafer 5. The second level-sensor 3*b* is adapted to measure a fixed level of the first stage surface of the polishing stage 1. The first level-sensor 3*a* may be configured to be in contact with the polishing surface of the wafer 5 to measure the variable level thereof. Alternatively, the first level-sensor 3*a* may also be configured to be distanced from the polishing surface of the wafer 5 to measure the variable level thereof. The second level-sensor 3*b* may be configured to be in contact with the first stage surface of the polishing stage 1 to measure the fixed level thereof. Alternatively, the second level-sensor 3*b* may also be configured to be distanced from the first stage surface of the polishing stage 1 to measure the fixed level thereof.

The first level-detector 3*a*' is mechanically coupled to the first level-sensor 3*a*, so that the first level-detector 3*a*' detects the first displacement G1 in level or vertical direction of the polishing surface of the semiconductor wafer 5. This mechanical coupling can be made by a known technique. The first level-detector 3*a*' converts the detected first displacement G1 into a first displacement signal. The first level-detector 3*a*' is also electrically coupled to the control unit 4 to transmit the first displacement signal to the control unit 4. This electrical coupling can also be made by a known technique. The second level-detector 3*b*' is mechanically coupled to the second level-sensor 3*b* so that the second level-detector 3*b*' detects the second displacement G2 in level or vertical direction of the first stage surface of the polishing stage 1. This mechanical coupling can be made by a known technique. The second level-detector 3*b*' converts the detected second displacement G2 into a second displacement signal. The second level-detector 3*b*' is also electrically coupled to the control unit 4 to transmit the second displacement signal to the control unit 4. This electrical coupling is also made by a known technique.

As described above, the second center axis of the polishing pad 2 is off-set from the first center axis of the polishing stage 1 to make an open space over a first half part of the semiconductor wafer 5. In the open space, the polishing pad 2 is absent. The first level-sensor 3*a* is, however, present in the open space and positioned over the first half part of the semiconductor wafer 5 in order to allow the first level-sensor 3*a* to contact the polishing surface of the first half part of the semiconductor wafer 5 during the polishing process. This allows the first level-sensor 3*a* to measure or to sense the first displacement G1 continuously during the polishing process.

The control unit 4 is provided to control the vertical motion of the polishing pad 2. The control unit 4 also respectively receives the first and second displacement signals from the first and second level-detectors 3*a*' and 3*b*'. The control unit 4 calculates an initial thickness of the semiconductor wafer 5 based on the first and second displacement signals. The control unit 4 sets plural inter-positions between the polishing pad 2 and the polishing stage 1 based on the calculated initial thickness of the semiconductor wafer 5. The control unit 4 changes the speed of the vertical motion of the polishing pad 2 with reference to the plural inter-positions.

(Setting Plural Speed-Changing Positions)

Figure 2:
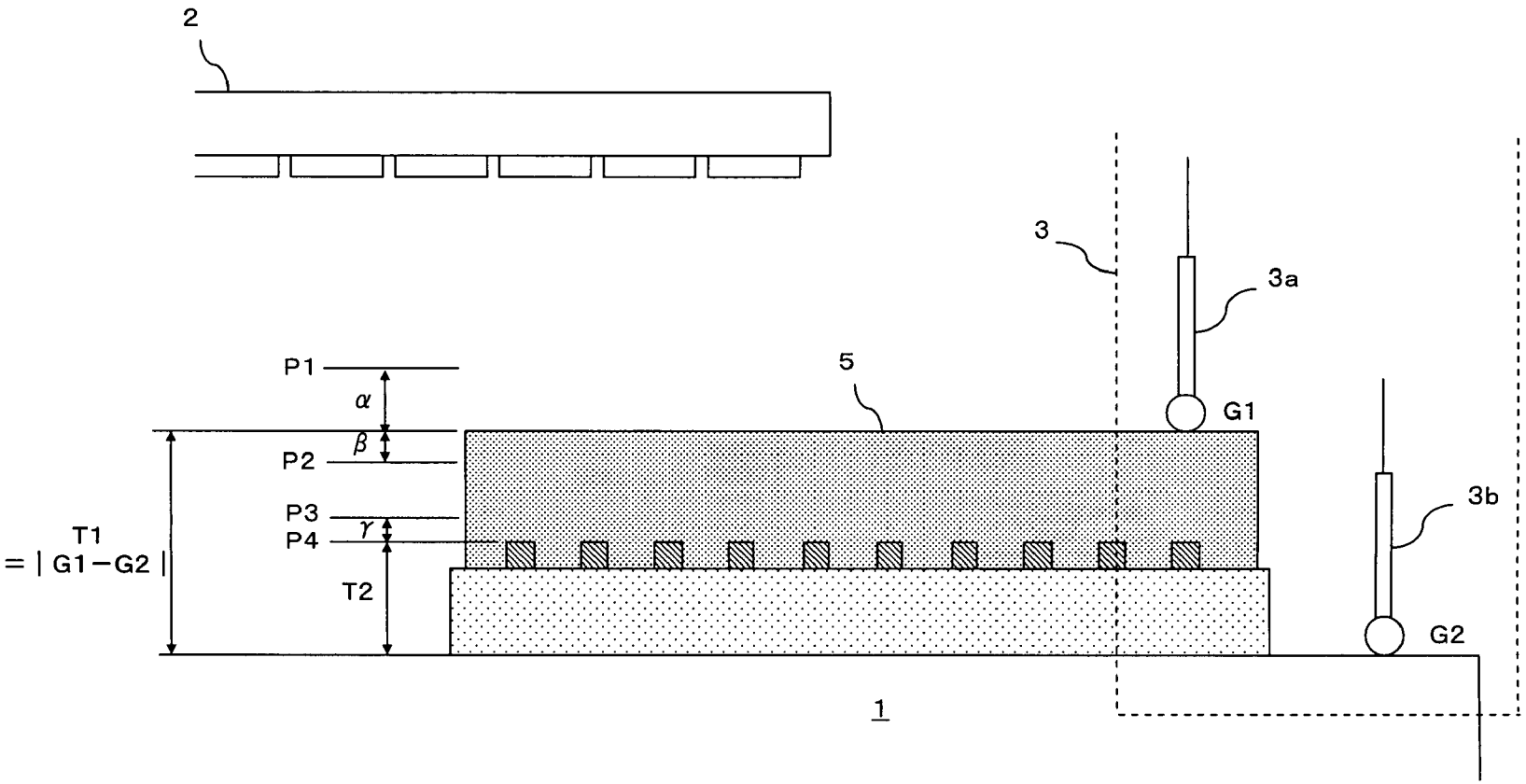
FIG. 2 is an enlarged fragmentary schematic view illustrating first to fourth speed-changing positions of the polishing apparatus of FIG. 1.

Prior to starting the polishing process, the control unit 4 sets first to fourth speed-changing positions P1, P2, P3, and P4, at which the speed of the vertical motion of the polishing pad 2 is changed. FIG. 2 illustrates first to fourth speed-changing positions P1, P2, P3, and P4 of the polishing apparatus of FIG. 1.

The first and second speed-changing positions P1 and P2 are set based on a measured initial thickness of the semiconductor wafer 5. The control unit 4 respectively receives the first and second displacement signals from the first and second level-detectors 3*a*' and 3*b*'. The first and second displacement signals represent the first and second displacements G1 and G2 measured by the first and second level-sensors 3*a* and 3*b*.

The first and second level-sensors 3*a* and 3*b* respectively measure the first and second displacements G1 and G2 in real time. The first and second level-detectors 3*a*' and 3*b*' respectively convert the detected first and second displacements G1 and G2 into the first and second displacement signals. The control unit 4 performs real time monitoring of a thickness of the semiconductor wafer 5 based on the first and second displacement signals, which respectively represent the detected first and second displacements G1 and G2.

The control unit 4 calculates an initial thickness T1 of the semiconductor wafer that has not yet been polished based on the first and second displacement signals representing the first and second displacements G1 and G2 measured by the first and second level-sensors 3*a* and 3*b*. For example, the control unit 4 calculates an absolute value of a difference between the first and second displacements G1 and G2, wherein the absolute value represents the initial thickness T1. The calculated initial thickness T1 is equal to the measured initial thickness of the semiconductor wafer 5 because the initial thickness T1 is derived from both the first and second displacements G1 and G2.

The control unit 4 further calculates a first sum of the calculated initial thickness T1 with a first correction value "α" in order to set the first speed-changing position P1 that is given by the calculated first sum. The control unit 4 establishes a first relationship of "P1=T1+α." The first correction value "α" is a predetermined constant.

The control unit 4 furthermore calculates a first remainder of subtracting a second correction value "β" from the initial thickness T1 in order to set the second speed-changing position P2 which is given by the calculated first remainder. The control unit 4 establishes a second relationship of "P2=T1−β." The second correction value "β" is a predetermined constant. The calculated initial thickness T1 is equal to the measured initial thickness of the semiconductor wafer 5 because the initial thickness T1 is derived from both the first and second displacements G1 and G2.

The first and second speed-changing positions P1 and P2 are calculated by predetermined corrections to the initial thickness T1 measured by the detector unit 3 to set the first and second speed-changing positions P1 and P2 in consideration of unavoidable variations in the initial thickness of the unpolished semiconductor wafer 5. This means that first and second distances of the first and second speed-changing positions P1 and P2 from the unpolished surface of the semiconductor wafer 5 are constant. When the polishing pad 2 reaches the first speed-changing position P1, the control unit 4 reduces the higher speed of the polishing pad 2 to a lower speed thereof. When the polishing pad 2 reaches the second speed-changing position P2, the control unit 4 increases the lower speed of the polishing pad 2 to a middle speed, i.e., a speed between the higher speed and lower speed.

It is required that the semiconductor wafer 5 be polished to have a final target thickness T2, which is predetermined for each type of the semiconductor wafer 5. The final target thickness T2 is different from a measured thickness of the completely polished semiconductor wafer 5. The third and fourth speed-changing positions P3 and P4 are set with reference to the final target thickness T2 of the semiconductor wafer 5.

The control unit 4 predetermines or sets the final target thickness T2 for each type of the semiconductor wafers 5. The control unit 4 further calculates a second sum of the final target thickness T2 with a third correction value "γ" in order to set the third speed-changing position P3 which is given by the calculated second sum. The control unit 4 establishes a third relationship of "P3=T2+γ". The third correction value "γ" is a predetermined constant.

The control unit 4 sets a fourth speed-changing position P4 with reference to the final target thickness T2. When the polishing pad 2 reaches the third speed-changing position P3, the middle speed is reduced to the lowest speed. When the polishing pad 2 reaches the fourth speed-changing position P4, the polishing pad 2 shows a moving change from the descent at the lowest speed to an ascent at the higher speed.

(Speed Control to Polishing Pad)

The above-described first to fourth speed-changing positions P1, P2, P3, and P4 have been set by the control unit 4 before the polishing process is started. FIGS. 3–7 illustrate relationships between the descending-speed and ascending speed and the above-described first to fourth speed-changing positions P1, P2, P3, and P4 relative to the semiconductor wafer 5 and/or the polishing stage 1. In this example, the polishing pad 2 has a constant rotational rate. However, it is possible as a modification to this embodiment that the polishing pad 2 exhibit a varying rotational rate. It is apparent from this disclosure that the axis of rotation of the polishing pad 2 extends in a direction in a direction that is substantially or is perpendicular to the polishing surface of the semiconductor wafer 5.

Figure 3:
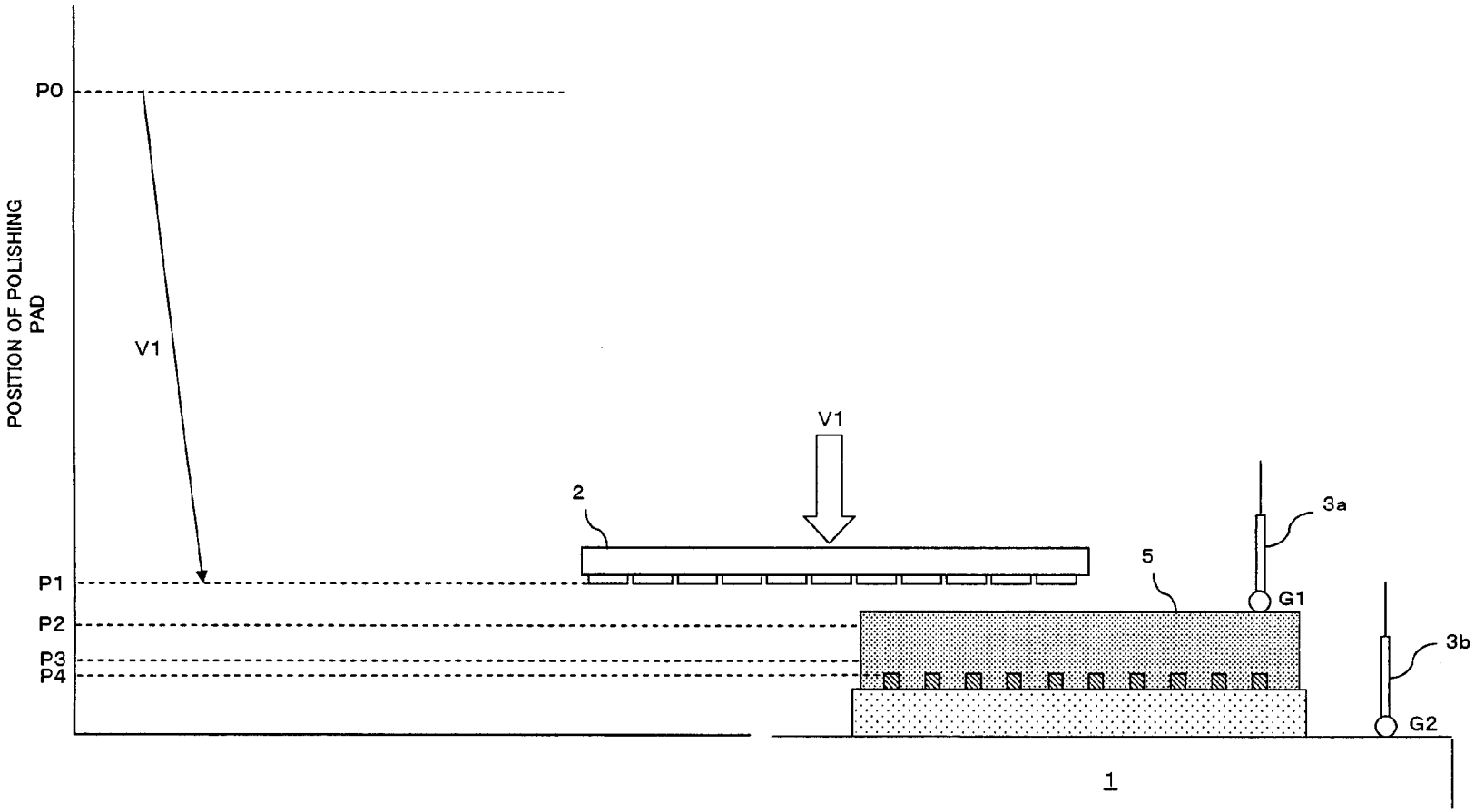
FIG. 3 is a fragmentary schematic view illustrating a first relationship of the first to fourth speed-changing positions and a first descending motion at a first descending speed of a polishing pad included in the polishing apparatus of FIG. 1.

As shown in FIG. 3, the control unit 4 makes the polishing pad 2 descend toward the semiconductor wafer 5 at a first speed or velocity V1 from the stand-by position P0 to the first speed-changing position P1. The first speed V1 is the highest speed during the polishing process. The first speed V1 may, for example, be at least 200 μm/min. Setting the first speed V1 as high as possible is effective to shorten the time until the polishing pad 2 reaches the polishing surface of the semiconductor wafer 5, while reducing or avoiding the impact damage to the semiconductor wafer 5 upon collision between them.

Figure 4:
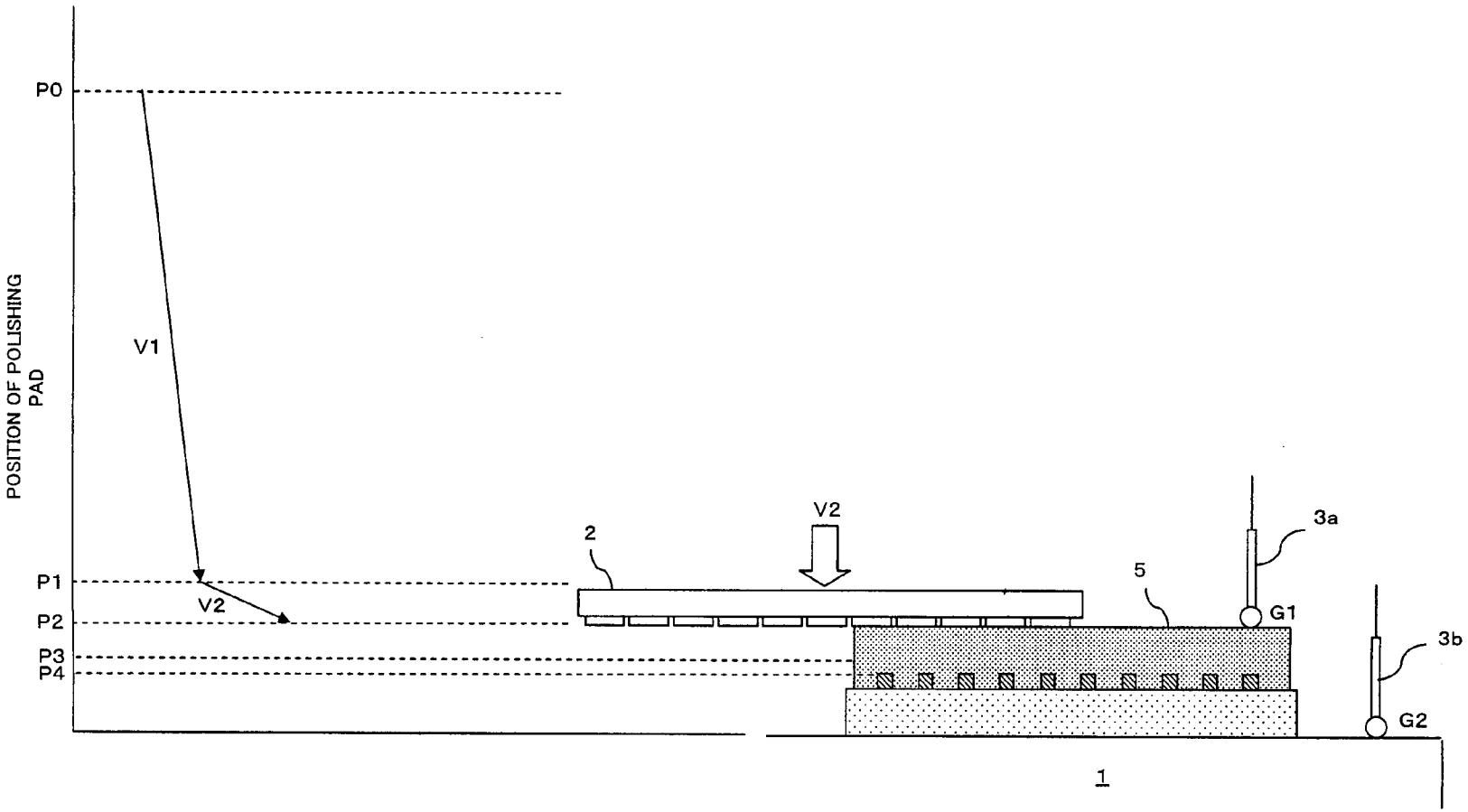
FIG. 4 is a fragmentary schematic view illustrating a second relationship of the first to fourth speed-changing positions and a second descending motion at a second descending speed of the polishing pad included in the polishing apparatus of FIG. 1.

As shown in FIG. 4, when the polishing pad 4 reaches the first speed-changing position P1, the control unit 4 reduces the first speed V1 to a second speed V2 which is lower than the first speed V1. The second speed V2 may, for example, be 100 μm/min. The control unit 4 makes the polishing pad 2 further descend at the second speed V2 from the first speed-changing position P1 toward the second speed-changing position P2, until the polishing pad 2 comes into contact with an unpolished surface of the semiconductor wafer 5 at the second speed-changing position P2. After the polishing pad 2 contacts the unpolished surface of the semiconductor wafer 5, the polishing pad 2 then polishes the surface of the semiconductor wafer 5 while maintaining the second speed V2 until the polishing pad 2 reaches the second speed-changing position P2.

The reduction from the first speed V1 to the second speed V2 prior to the contact between the polishing pad 2 and the semiconductor wafer 5 avoids or reduces possible impact damage to the semiconductor wafer 5 upon collision with the polishing pad 2 on descent. To avoid or to reduce the impact damage, it is important to reduce impact force applied to the semiconductor wafer 5 upon contact between the polishing pad 2 and the semiconductor wafer 5. It is also important to avoid application of any excessive force to the semiconductor wafer 5 until the polishing pad 2 is well-engaged with the polishing surface of the semiconductor wafer 5. The above-described speed control by the control unit 4 is effective to reduce or to avoid the impact damage to the semiconductor wafer 5.

As described above, the first and second speed-changing positions P1 and P2 are set with reference to the initial thickness T1 obtained by the measurement by the detector unit 3 to the actual thickness of the unpolished semiconductor wafer 5. Thus, the first and second speed-changing positions P1 and P2 are predetermined by taking into account unavoidable variations in the actual initial thickness of the unpolished semiconductor wafer 5. This means that the first and second distances of the first and second speed-changing positions P1 and P2 from the unpolished surface of the semiconductor wafer 5 are constant. This ensures that possible impact damage to the semiconductor wafer 5 be reduced or avoided.

The first and second speed-changing positions P1 and P2 as set in consideration of unavoidable variations in the actual initial thickness of the unpolished semiconductor wafer 5 also allows maximizing the first distance between the stand-by position P0 and the first speed-changing position P1, while minimizing the second distance between the first and second speed-changing position P1 and P2. This allows shortening the time until the polishing pad 2 reaches the polishing surface of the semiconductor wafer 5, while reducing or avoiding the impact damage to the semiconductor wafer 5 upon contact between them. When the polishing pad 2 reaches the second speed-changing position P2, the polishing pad 2 may have already been well-engaged with the polishing surface of the semiconductor wafer 5, and the polishing would have been stabilized.

Figure 5:
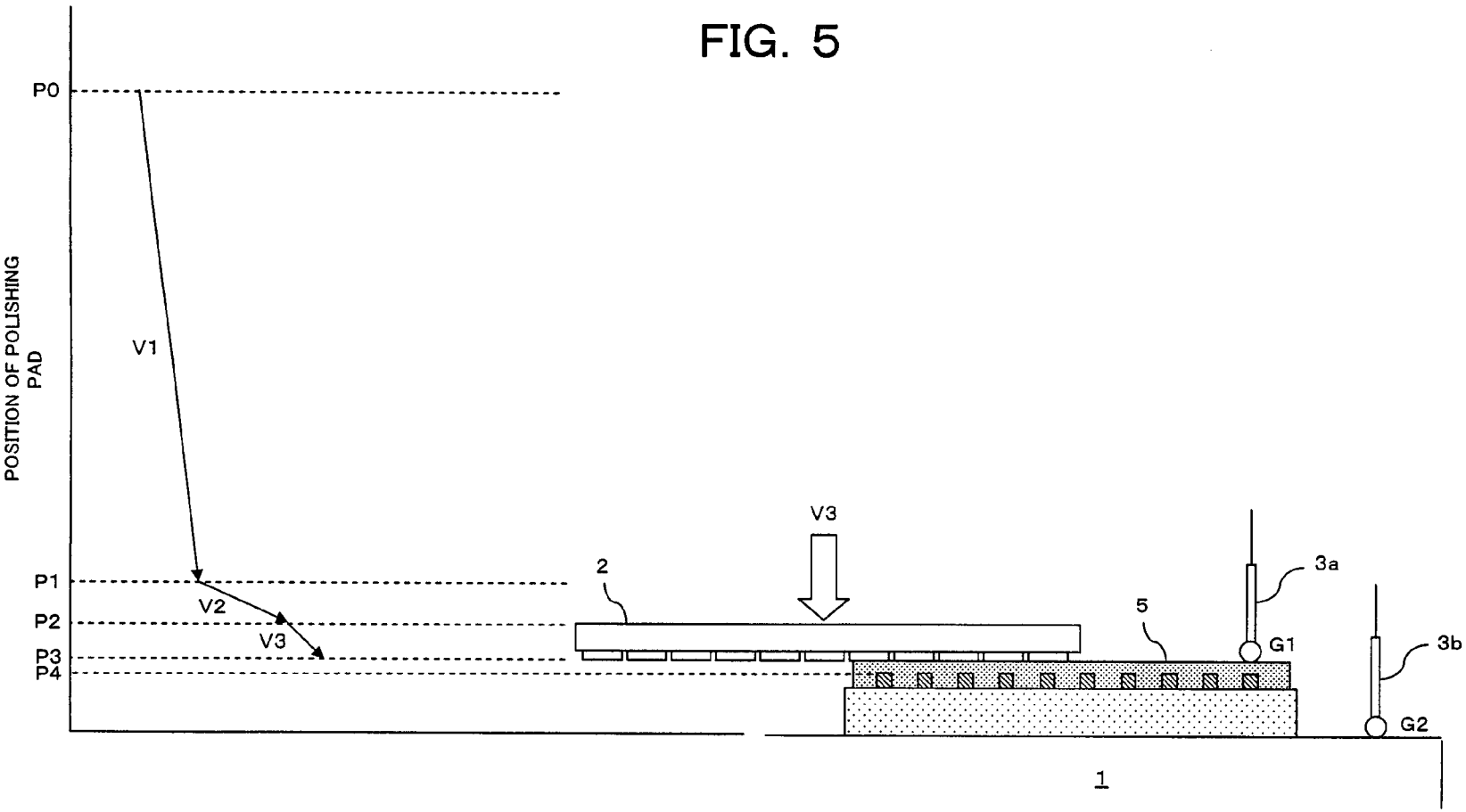
FIG. 5 is a fragmentary schematic view illustrating a third relationship of the first to fourth speed-changing positions and a third descending motion at a third descending speed of the polishing pad included in the polishing apparatus of FIG. 1.

As shown in FIG. 5, when the polishing pad 4 while polishing the semiconductor wafer 5 at the second speed V2 reaches the second speed-changing position P2, the control unit 4 increases the second speed V2 to a third speed V3 which is higher than the second speed V2. The third speed V3 may, for example, be 200 μm/min. The control unit 4 makes the polishing pad 2 continue to polish further the semiconductor wafer 5 while maintaining the third speed V3 until the polishing pad 2 reaches the third speed-changing position P3. The increase from the second speed V2 to the third speed V3 shortens polishing time and increases the polishing rate. After the polishing pad 2 has already been well-engaged with the polishing surface of the semiconductor wafer 5, and the polishing has been stabilized, the control unit 4 increases the polishing rate or increases the second speed V2 to the third speed V3 to avoid any excessive damage to the semiconductor wafer 5.

Figure 6:
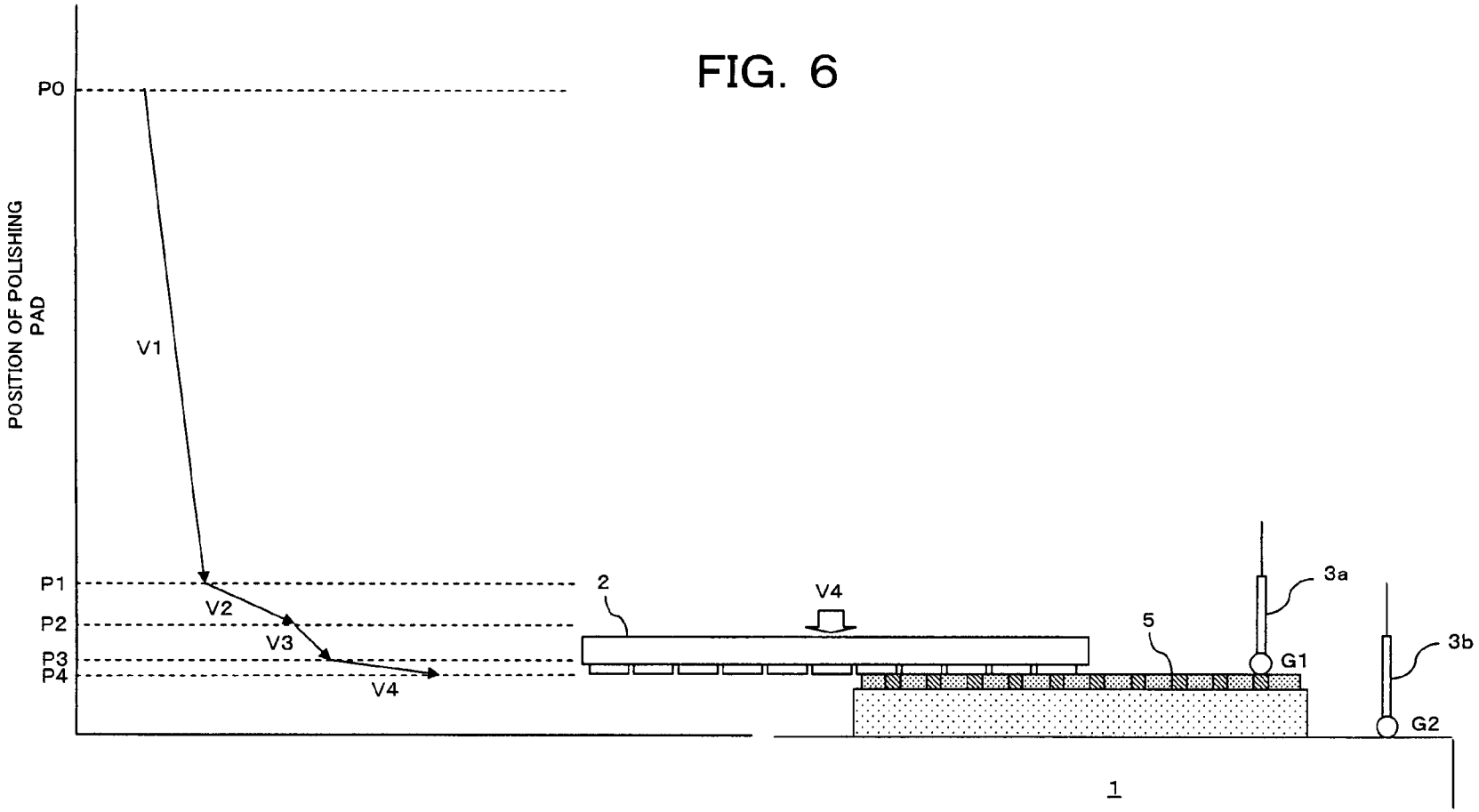
FIG. 6 is a fragmentary schematic view illustrating a fourth relationship of the first to fourth speed-changing positions and a fourth descending motion at a fourth descending speed of the polishing pad included in the polishing apparatus of FIG. 1.

As shown in FIG. 6, when the polishing pad 2 reaches the third speed-changing position P3, the control unit 4 reduces the third speed V3 of the polishing pad 2 to a fourth speed V4 which is lower than the second and third speeds V2 and V3. Namely, the fourth speed V4 is the lowest speed. The fourth speed V4 may, for example, be at most 50 μm/min. The control unit 4 makes the polishing pad 2 further polish the semiconductor wafer 5 while maintaining the fourth speed V4 as a final dressing process until the polishing pad 2 reaches the fourth speed-changing position P4. The reduction from the third speed V3 to the fourth speed V4 is effective to ensure highly accurate control when ending the polishing process at a polishing-end position that corresponds to the fourth speed-changing position P4. Namely, when the polishing pad 2 reaches the fourth speed-changing position P4, the thickness of the semiconductor wafer 5 has just been reduced to the final target thickness T2, and the polishing has just been completed and terminated.

Figure 7:
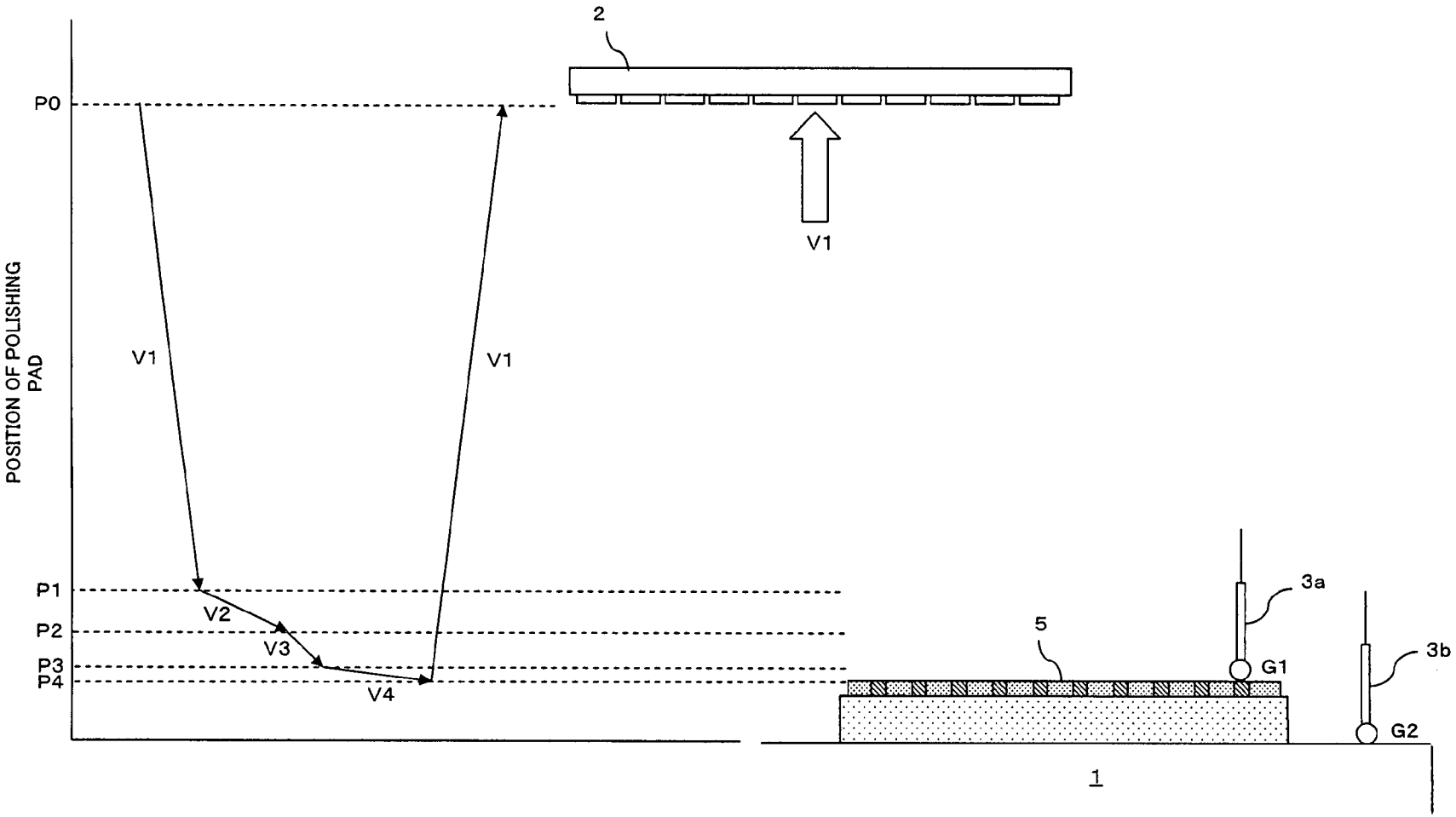
FIG. 7 is a fragmentary schematic view illustrating a fifth relationship of the first to fourth speed-changing positions and a first ascending motion at a first ascending speed of the polishing pad included in the polishing apparatus of FIG. 1.

As shown in FIG. 7, when the polishing pad 2 reaches the fourth speed-changing position P4, the control unit 4 terminates the polishing process and makes the polishing pad 2 ascend or depart at the first speed V1 to the stand-by position P0 from the completely polished semiconductor wafer 5 having the final target thickness T2. As described above, the first speed V1 may, for example, be at least 200 μm/min. Setting the first speed V1 as high as possible is effective to shorten the polishing process time.

It is also possible as a modification to the present invention that one or more additional speed-changing positions to the above first to fourth speed-changing positions are set prior to the polishing process.

In view of many possible embodiments to which the principles of the present invention may be applied, it should be recognized that the detailed embodiments are illustrative only and should not be taken as limiting the scope of the present invention.

This application claims priority to Japanese Patent Application No. 2004-236976, the entire disclosure of which is herein incorporated by reference.

As used herein, the following directional terms "forward, rearward, above, downward, vertical, horizontal, below, and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A method for polishing a semiconductor wafer comprising:

placing the semiconductor wafer on a first surface of a retainer, the semiconductor wafer having a second surface which is opposite to said retainer and which is to be polished by a polishing pad;

measuring an initial thickness of the semiconductor wafer to obtain a measured initial thickness value;

causing said polishing pad to relatively move at a predetermined first moving speed from a predetermined first position to a second position, said second position being set between said first position and said second surface, and being spaced from said first surface by a first sum of said measured initial thickness value of the semiconductor wafer and a predetermined first correction value; and causing said polishing pad to relatively move at a second moving speed from which is lower than said first moving speed from said second position to a third position while conducting an initial polishing process to polish said semicondictor wafer using said polishing pad, said third position being set between said second position and said first surface, and being spaced from said first surface by a first remainder obtained by subtracting a predetermined second correction value from said measured initial thickness value.

2. The method of polishing the semiconductor wafer according to claim 1, further comprising:

predetermining a final target thickness value of the semiconductor wafer, setting a polishing end position with reference to said final target thickness value, and conducting a post-polishing process following said initial polishing process to polish said semiconductor wafer until said polishing pad reaches said polishing end position.

3. The method of polishing the semiconductor wafer according to claim 2, further comprising:

predetermining a third moving speed being higher than said second moving speed, predetermining a fourth moving speed being lower than said first, second and third moving speeds, and wherein conducting said post-polishing process further comprises conducting a first post-polishing process following said initial polishing process to polish said semiconductor wafer at said third moving speed, and conducting a second post-polishing process following said first post-polishing process to polish said semiconductor wafer at said fourth moving speed.

4. The method of polishing the semiconductor wafer according to claim 3, further comprising:

predetermining a third correction value, setting a fourth position between said third position and said polishing end position, said fourth position being spaced from said first surface by a second sum of said final target thickness value and said third correction value, and wherein conducting said first post-polishing process comprises polishing said semiconductor wafer until said polishing pad reaches said fourth position.

5. The method of polishing the semiconductor wafer according to claim 4, wherein conducting said second post-polishing process comprises polishing said semiconductor wafer until said polishing pad reaches said polishing end position.

* * * * *